US005185688A

United States Patent [19]

Krebs, Jr.

[11] Patent Number: 5,185,688

[45] Date of Patent: Feb. 9, 1993

[54] SPLIT CORE DEGAUSSING COIL LOOP

[75] Inventor: Joseph V. Krebs, Jr., Gautier, Miss.

[73] Assignee: Ingalls Shipbuilding, Inc., Pascagoula, Miss.

[21] Appl. No.: 692,252

[22] Filed: Apr. 26, 1991

[51] Int. Cl.[5] ..... H01F 13/00; H01F 27/24; H01F 27/26

[52] U.S. Cl. ..... 361/267; 336/210; 336/212; 336/216; 336/217

[58] Field of Search ..... 335/284; 336/221, 225, 336/210, 212, 216, 217; 361/143, 149, 150, 161, 157, 267

[56] References Cited

U.S. PATENT DOCUMENTS

| | | | |
|---|---|---|---|
| 2,318,415 | 5/1943 | Patzchke | 171/242 |
| 2,848,660 | 8/1958 | Boyers | 317/157.5 |
| 4,048,605 | 9/1977 | McCollum | 336/176 |
| 4,218,722 | 8/1980 | Yoshizawa | 361/149 |

*Primary Examiner*—Sharon D. Logan
*Assistant Examiner*—Michael A. Friedhofer
*Attorney, Agent, or Firm*—D. J. Ellingsberg

[57] ABSTRACT

A split core degaussing coil loop having a segmented and disassembled loop portion that is joined together to include an object to be demagnetized, in situ, as part of the assembled core loop and further having an inductor coil assembled with the loop that is selectively energized in one or more steps from a source of electrical power which generates a demagnetizing force directed to the object.

8 Claims, 1 Drawing Sheet

SPLIT CORE DEGAUSSING COIL LOOP

BACKGROUND OF THE INVENTION

Certain tangible objects when formed from such elements as iron, cobalt nickel, and the like respond to the effect of a magnetizing force and become magnetic. This is often desirable; for example, in the production of permanent magnets and in the operation of electromagnets. In certain instances, however, this quality is not desirable.

One instance where this magnetic quality is not desirable is when the object is used as a measurement reference. Where the object is a gear in an engine, the gear's teeth can be used as a reference for one or more magnetic proximity pickups or sensors in monitoring the gear's revolutions per minute (RPM). Such monitoring of the gear can be used to control engine RPM, and to stop the engine in the event of an over speed condition. However, a gear that exhibits residual magnetism (here an undesirable quality) will interfere with the normal operation of the magnetic pickups when the gear's teeth act to vary the magnetic flux density sensed by the pickups.

Where an object such as a gear can be easily removed and demagnetized or replaced, the interruptive effect of this form of gear failure can be relatively small. But where the gear is internal to a large engine, such as a gas turbine engine, the interruptive effect can be large.

Gas turbine engines are key to modern propulsion systems for aircraft, land vehicles, and sea vessels. Any nonoperating time obviously becomes costly. The downtime to physically remove the gear (if not the entire engine to have easier access to the gear), demagnetize or replace the gear and to reinstall it, (and reinstall the engine in certain instances) is significant; and therefor is costly.

SUMMARY OF THE INVENTION

Briefly, in accordance with the invention, a split core degaussing coil loop device is provided to demagnetize an object, in situ, where a segmented split core has a main body portion that terminates in a pair of spaced-apart opposing ends with the object positioned therebetween, and an inductor core/coil positioned with the main body portion that is connected to a source of electrical power and selectively energized so that a predetermined demagnetizing force is generated for a selected period of time through the loop defined by the assembled split core and the object which thereby demagnetizes the object.

OBJECTS OF THE INVENTION

Accordingly, it is an object of the invention to provide a new and improved split core loop for demagnetizing an object that exhibits residual magnetism.

It is an object of the invention to provide a new and improved split core degaussing coil loop for demagnetizing an object in situ.

It is an object of the invention to provide a new and improved split core degaussing coil loop for demagnetizing an object with a minimal downtime of the system in which the object finds use.

It is an object of the invention to provide a new and improved split core degaussing coil loop that is segmented for portability and ease of assembly in situ, and is flexible for accurate positioning with reference to an object which is to be demagnetized.

Further objects and the attending advantages of the invention will become readily apparent and understood when the following description is read in view of the accompanying drawing.

DESCRIPTION OF THE PREFERRED EMBODIMENT

Figure 1:
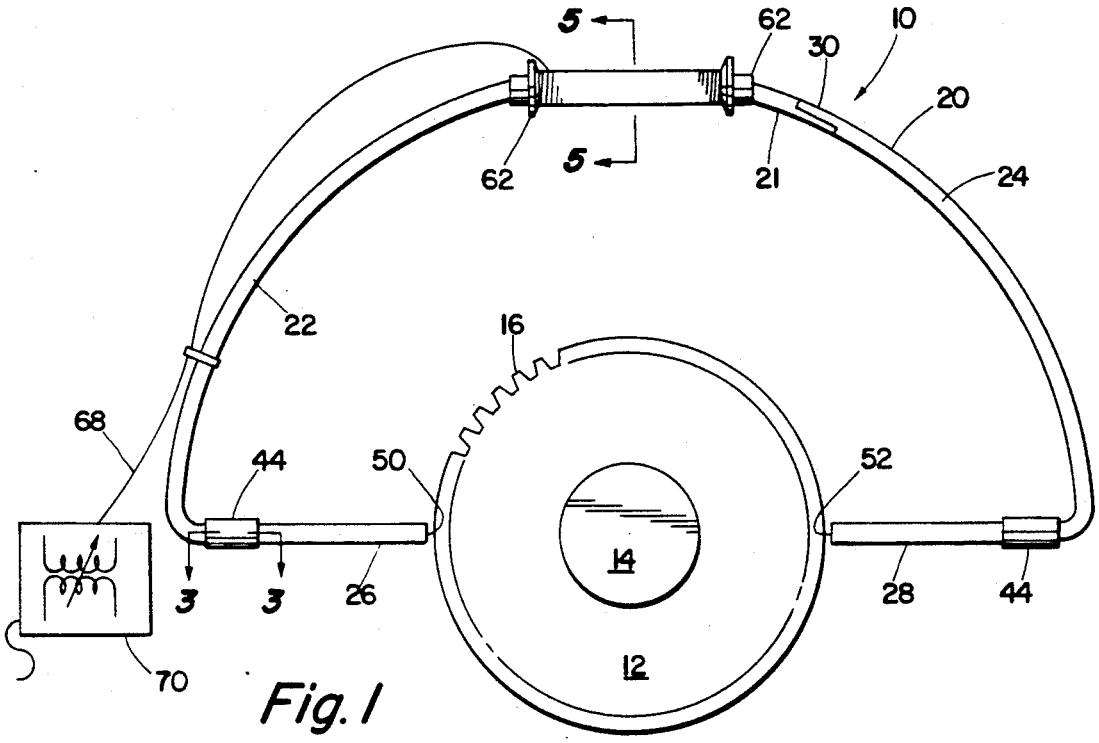
FIG. 1 is an elevation view of the split core degaussing coil loop of the invention.

Referring to FIG. 1, the split core degaussing coil loop 10 of the invention is illustrated in an operating position relative to a gear 12 that is mounted on shaft 14 of a engine, such as a conventional gas turbine engine.

As has been described under BACKGROUND, the gear 12 has a plurality of teeth 16. The split core degaussing coil loop 10 of the invention finds use when gear 12 exhibits residual magnetism since the invention is used to demagnetize the gear 12 and thereby its teeth 16.

The split core loop 20 is formed from a mild steel such as would be use in a conventional electromagnet. The loop 20 is segmented into four (4) sections 22, 24, 26 and 28 that are relatively flexible and that can be assembled and disassembled in situ.

Figure 2:
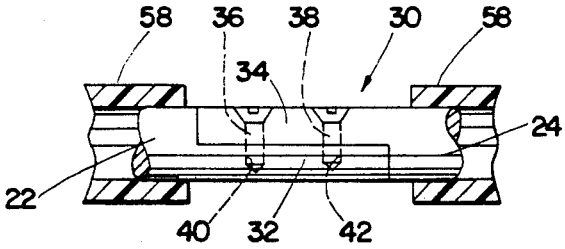
FIG. 2 is an enlarged view, partly sectional, of a portion of the split core of FIG. 1.

Sections 22 and 24 are joined by a preformed lapped joint 30 as shown by FIG. 2. Joint 30 includes the half lap ends 32 and 34 to prevent turning. The half lap ends are joined together by suitable machine thread fasteners 36 and 38 that are threaded into respective drilled and tapped holes 40 and 42 in the associated half lap ends 32 and 34. Fasteners 36 and 38 can have flat, countersunk heads with standard slotted drives as illustrated.

Figure 3:
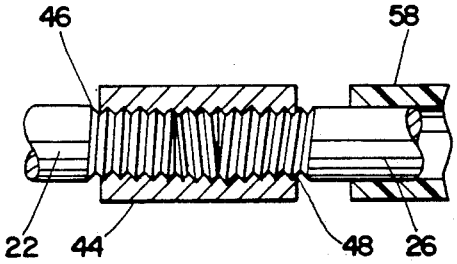
FIG. 3 is an enlarged cross-sectional view along the line 3—3 of FIG. 1.

Sections 26 and 28 of the split core loop 20 of FIG. 1 can be of varying lengths, and are joined to respective sections 22 and 24 by a threaded screw coupling 44 as more clearly shown by FIG. 3. Coupling 44 receives the threaded ends 46 and 48 of split core sections 22 and 24 respectively. Coupling 44 may have right and left-hand threads with respective ends 46 and 48 having complementary threads.

The split core loop 20 with its sections 22 and 24 generally develops a half-circle, although this geometry is not critical to the operation of the invention. However, it is considered critical that sections 26 and 28 be initially positioned so that their respective free ends 50 and 52 can be placed in relatively close proximity to the gear teeth 16. In the final operating position, the free ends 50 and 52 preferably physically touch the gear teeth 16 as will be described. This can be readily accomplished by flexing sections 22 and 24 inwardly toward the gear 12 so that the sections 26 and 28 move toward gear 12 and into the desired contact with the gear teeth 16.

The split core loop 20 can be insulated with an electrically nonconductive sleeve 58 which is not shown by FIG. 1 but is clearly shown by FIGS. 2 and 3. Sleeve 58 can be formed from a suitable electrically nonconductive plastic material.

Figure 4:
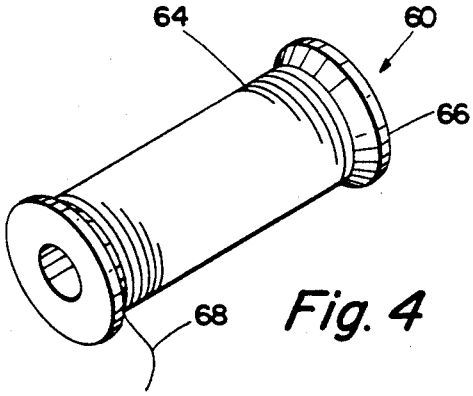
FIG. 4 is an enlarged, perspective view of the inductor coil associated with the split core loop of the invention as illustrated by FIG. 1.

Sleeve 58, however, does not extend into the apex or bight region 21 of the split core loop 50 which receives an inductor coil assembly 60 as shown by FIGS. 1 and 4. This apex region has a woven glass, heat resistant sleeve 62 that is installed under at least the full length of the inductor coil assembly 60.

Figure 5:
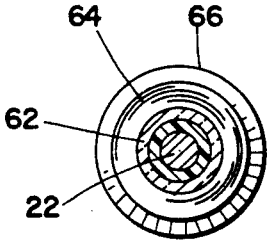
FIG. 5 is an enlarged, cross-sectional view of the inductor coil of FIG. 4 in one operating position relative to the split core loop of the invention along the line 5—5 of FIG. 1.

The inductor coil assembly 60 as shown by FIGS. 4 and 5 has a wire-wound coil 64 on a spool 66 of a nonmagnetic material. In one operation, the split core degaussing coil loop 10 of the invention has an inductor coil assembly 60 having a fiber glass spool 66 that was wound with 350 turns of #11 AWG Class F Tri-Coat Magnet wire®. The wire-wound coil 64 is connected by a standard power cord 68 to a 120 volt, 60 cycle source of alternating current that is controlled by a 120 volt Variac® power supply (not shown but standard). In this operation, the selected 120 volt Variac® had a minimum capacity of 10 amperes.

Operationally, the split core degaussing coil loop 10 of the present invention was used to demagnetize an internal gear in a LM2500 Gas Turbine Engine Manufactured by the General Electric Co., Fairfield, Conn. The gear 12 had a diameter of about six feet or 1.83 meters.

It was necessary to remove the two proximity pickups associated with the standard instrumentation used to monitor the gear's RPM. These two pickups were replaced with the two generally straight sections 26 and 28 of the split core loop 20. Sections 26 and 28 were assembled to the respective sections 22 and 24 by the similar screw coupling 44. The inductor coil assembly was positioned over the glass insulating sleeve 62 on section 22, and then section 22 was joined to section 24 by the assembled lap joint 30.

The assembled split core loop 20 was then flexed inwardly toward the toothed periphery of the gear 12 until the free ends 50 and 52 of straight sections 26 and 28, respectively, physically contact the gear's teeth 16.

The inductor coil assembly 60 was connected by the power cord to the standard Variac® power supply which had been adjusted or set to deliver a 10 volt output. Physical powered contact between the free ends 50 and 52 of the split core loop 20, and the gear's teeth 16 was maintained for about 15 seconds. The core was then flexed outwardly so that the free ends 50 and 52 no longer were in physical contact with the gear's teeth 16, the gear 12 was rotated about 10 degrees, the core was flexed inwardly to again contact the gear's teeth, and this contact again held for another 15 seconds. This sequence of degaussing or demagnetizing steps was repeated through a complete 360 degree rotation of the gear 12 so that the entire gear toothed periphery was exposed to one cycle of the demagnetizing force. Since the gear 12 was about six feet or 1.83 meters in diameter, twelve (12) complete cycles were used for this gear.

Upon the completion of the desired operation cycle(s), the split core loop 20 is flexed outwardly so that the free ends 50 and 52 no longer physically contact the gear teeth 16, and the voltage supply from the Variac® source is decreased to zero and then switched off.

Removal of the split core degaussing coil loop 10 of the invention is accomplished by the reverse process to that as described for the assembly of the loop 10 in an operating position. The proximity leads can then be reinstalled and the engine returned to normal operation with properly functioning sensors for gear RPM.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart form the true spirit and scope of the invention.

I claim:

1. In a system having an object that has become magnetized and which is to be demagnetized in situ, a demagnetizing device characterized in that the device is a split core degaussing coil loop comprising:

a) a segmented split core having a main body portion that terminates in a pair of spaced-apart opposing ends with the object positioned therebetween, said split core further having a plurality of removably joined segments which include at least a pair of arcuate segments and a pair of generally straight segments.

b) each of said arcuate segments having a half lap end joined together as a lapped joint, said joined arcuate segments developing an approximate half circle having a bight portion, c) an electrically nonconductive core sheath that partially encases said segmented split core, said lapped joint and bight portion are uncased by said sheath, d) an inductor core positioned with said main body portion at said bight portion, and e) a variable source of a.c. electrical power connected to said inductor core so that a predetermined demagnetizing force is generated for a selected period of time through the loop defined by said split core and the object which thereby demagnetizes the object.

2. The split core degaussing coil loop of claim 1 in which said segmented split core is formed from mild steel.

3. The split core degaussing coil loop of claim 1 in which said inductor core is separated from said uncased bight portion by an inductor sheath that is both electrically nonconductive and heat resistant.

4. In a system having an object that has become magnetized and which is to be demagnetized in situ, a demagnetizing device characterized in that the device is a split core degaussing coil loop comprising:

a) a flexible, segmented split core loop having a half-circle geometry developing an arch or bight portion and a pair of opposing, spaced-apart loop ends with the object positioned therebetween, b) an inductor core positioned on said loop at said bight portion, c) a source of electrical energy, d) a variable electrical power control connected between said source and said inductor core, e) electrically nonconductive thermal insulation positioned on said bight portion between said segmented loop and said inductor core, and f) electricall. nonconductive insulation positioned on said segmented loop adjoining said inductor core so that the object is demagnetized when said inductor coil is selectively energized.

5. The split core degaussing coil loop of claim 4 in which said segmented split core loop can be disassembled and said inductor core removed from said loop.

6. The split core degaussing coil loop of claim 4 in which said source of electrical energy is an alternating current source.

7. The split core degaussing coil loop of claim 4 in which said loop ends can be selectively flexed toward and away from physical contact with the object.

8. The split core degaussing coil loop of claim 4 in which the object completes a magnetic flux path that includes said split core loop and the object.

* * * * *